US009527201B2

(12) United States Patent
Ullrich et al.

(10) Patent No.: US 9,527,201 B2
(45) Date of Patent: Dec. 27, 2016

(54) PORTABLE POWER TOOL

(75) Inventors: Andre Ullrich, Leinfelden-Echterdingen (DE); Siegfried Fehrle, Leinfelden-Echterdingen (DE); Thomas Bernhardt, Nanjing (CN)

(73) Assignee: Robert Bosch GmbH, Stuttgart (DE)

( * ) Notice: Subject to any disclaimer, the term of this patent is extended or adjusted under 35 U.S.C. 154(b) by 1220 days.

(21) Appl. No.: 13/515,483

(22) PCT Filed: Oct. 15, 2010

(86) PCT No.: PCT/EP2010/065511
§ 371 (c)(1),
(2), (4) Date: Sep. 21, 2012

(87) PCT Pub. No.: WO2011/072907
PCT Pub. Date: Jun. 23, 2011

(65) Prior Publication Data

US 2013/0168121 A1 Jul. 4, 2013

(30) Foreign Application Priority Data

Dec. 15, 2009 (DE) ..... 10 2009 054 640

(51) Int. Cl.
*B25F 5/02* (2006.01)
*B25D 17/00* (2006.01)

(52) U.S. Cl.
CPC ..... *B25F 5/02* (2013.01); *B25D 17/00* (2013.01); *B25D 2250/065* (2013.01); *B25D 2250/121* (2013.01)

(58) Field of Classification Search
CPC ..... Y10T 74/2186; B25D 16/006; B25D 2250/121; B25F 5/00; B25F 5/001; B25F 23/14; B25F 5/02; B25B 21/00; B25B 23/147
USPC .... 173/217, 47, 162.2, 48, 109, 29, 20, 216, 173/213
See application file for complete search history.

(56) References Cited

U.S. PATENT DOCUMENTS 6,902,013 B2 * 6/2005 Aeberhard ..... 173/213
2003/0121676 A1 * 7/2003 Ortt ..... B25F 5/02 173/1
2005/0236170 A1 10/2005 Lee
2006/0032645 A1 2/2006 Shimma et al.
(Continued)

FOREIGN PATENT DOCUMENTS

CN 1775486 A 5/2006
CN 101516578 A 8/2009
(Continued)

OTHER PUBLICATIONS

International Search Report corresponding to PCT Application No. PCT/EP2010/065511, mailed Feb. 17, 2011 (German and English language document) (7 pages).

*Primary Examiner* — Michelle Lopez
(74) *Attorney, Agent, or Firm* — Maginot, Moore & Beck LLP

(57) ABSTRACT

A hand-power tool, in particular a drill and/or chiseling hammer, includes a transmission, a machine housing, and an inner housing arranged within the machine housing. The inner housing is provided for at least partially receiving at least one transmission element of the transmission. The at least one transmission element is supported jointly by the inner housing and by the machine housing.

18 Claims, 5 Drawing Sheets

(56) References Cited

U.S. PATENT DOCUMENTS

| | | | | |
|---|---|---|---|---|
| 2007/0125563 | A1* | 6/2007 | Furusawa | B25D 16/006 173/48 |
| 2009/0223693 | A1 | 9/2009 | Aoki | |
| 2009/0288851 | A1* | 11/2009 | Hamano et al. | 173/122 |
| 2009/0321101 | A1* | 12/2009 | Furusawa | B25D 17/043 173/162.2 |

FOREIGN PATENT DOCUMENTS

| | | | |
|---|---|---|---|
| DE | 34 05 922 | A1 | 8/1985 |
| DE | 20 2005 021 085 | U1 | 1/2007 |
| EP | 1 674 215 | A1 | 6/2006 |
| EP | 2 127 820 | A1 | 12/2009 |
| WO | 2006/010675 | A1 | 2/2006 |

* cited by examiner

PORTABLE POWER TOOL

This application is a 35 U.S.C. §371 National Stage Application of PCT/EP2010/065511, filed on Oct. 15, 2010, which claims the benefit of priority to Serial No. DE 10 2009 054 640.5, filed on Dec. 15, 2009 in Germany, the disclosures of which are incorporated herein by reference in their entirety.

BACKGROUND

DE 34 05 922 discloses a portable power tool, in particular a rotary hammer, having a transmission, a machine housing and an inner housing arranged inside the machine housing, wherein the inner housing is provided to receive transmission elements of the transmission. In this case, the transmission elements are mounted in the inner housing by means of bearing elements. The inner housing supports the transmission elements in an axial direction and in a radial direction.

SUMMARY

The disclosure relates to a portable power tool, in particular a rotary and/or demolition hammer, having a transmission, having a machine housing and having an inner housing arranged inside the machine housing, said inner housing being provided to at least partially receive at least one transmission element of the transmission.

It is proposed that the at least one transmission element is mounted in a manner distributed between the inner housing and the machine housing. The term "transmission" is intended to be understood here in particular as a mechanism which comprises at least two components, in particular transmission elements, which are provided, by means of interaction, to change at least the amount of a force, of a torque and/or of a rotational speed and/or with the aid of which a form of movement, such as a rotation, can be converted into a different form of movement, such as a translational movement, and/or which are provided to transmit percussive pulses. The components, in particular transmission elements, can in this case be in the form of gearwheels, shafts, strikers, percussive pins, hammer tubes, swash bearings, bearings and other components that appear to be practical to a person skilled in the art. Advantageously, the at least one transmission element is in the form of a hammer tube and/or of a shaft, in particular in the form of an output shaft and/or intermediate shaft. In this context, "provided" is intended to be understood as meaning in particular especially equipped and/or especially designed.

The term "machine housing" should be understood here in particular as defining an outermost cover which encloses the components of the portable power tool so that the components of the portable power tool are protected substantially against external influences, the cover being provided to allow a user of the portable power tool to grip and operate, in particular guide, the portable power tool. In this case, the machine housing can be formed from a unit which comprises at least two housing half-shells which can be joined together along a connecting plane. Particularly preferably, the machine housing is formed from a number of units, in particular from a transmission housing and a motor housing, wherein the transmission housing and the motor housing are formed in a pot-like manner. In order to form the machine housing, the pot-like transmission housing and the pot-like motor housing are connected together in a connecting plane by means of connecting elements which are known to a person skilled in the art. However, it is also conceivable for the transmission housing and the motor housing to have in each case two housing half-shells, which can be joined together in each case along a connecting plane. The machine housing can be formed from various materials that appear to be practical to a person skilled in the art, such as, for example, a metal, a nonferrous metal, etc., preferably a plastics material. The term "inside" is intended to be understood here in particular as defining a spatial position of at least the inner housing in relation to the machine housing, wherein the inner housing is enclosed substantially by the machine housing, in particular in a common plane which extends substantially perpendicularly to a rotational axis of a transmission element arranged inside the inner housing and/or to a rotational axis of a tool mount of the portable power tool. The expression "partially receive" is intended to be understood here in particular as an arrangement of the at least one transmission element in the inner housing, wherein at least subregions of the at least one transmission element are received in the inner housing, in particular are surrounded in a substantially form-fitting manner, so that at least one degree of freedom of movement of the at least one transmission element can be at least partially restricted. In connection with mounting of the at least one transmission element, "distributed" is intended to be understood in particular as meaning uncoupling of the inner housing from the machine housing with regard to a bearing function, in particular a radial bearing function, of the at least one transmission element. Thus, at least one bearing force of the at least one transmission element is supported via the inner housing and at least one bearing force of the at least one transmission element is supported via the machine housing in a manner uncoupled from the inner housing.

By means of the configuration according to the disclosure of the portable power tool, it is possible to counteract a summation of tolerances of a mounting of transmission elements in a particularly advantageous manner. As a result, play of the transmission elements, which is dependent on the tolerances, can particularly advantageously be kept low. In particular in the case of transmission elements which are driven in rotation, such as in particular an output shaft and/or an intermediate shaft, a high running accuracy, in particular a high true-running accuracy, can advantageously be achieved by way of the configuration according to the disclosure. In this way, the development of vibration can advantageously be counteracted.

Advantageously, the inner housing is provided to at least axially support the at least one transmission element. The designation "axially support" is intended to be understood here in particular as an arrangement at least of the inner housing in relation to the at least one transmission element, wherein the at least one transmission element bears directly or indirectly at least partially against the inner housing so that a flux of force can take place between the at least one transmission element and the inner housing, in particular a flux of force which runs in a substantially parallel manner to the rotational axis of a transmission element arranged inside the inner housing and/or to the rotational axis of a tool mount of the portable power tool. Furthermore, by means of the axial support, at least one degree of freedom of movement of the at least one transmission element in at least one direction, in particular substantially parallel to the rotational axis of a transmission element arranged inside the inner housing and/or to the rotational axis of the tool mount of the portable power tool, is intended to be restricted. The expression "substantially parallel" is intended to be understood here in particular as defining a direction which deviates from a reference direction by in particular less than 8°, advantageously less than 5° and particularly advantageously less than 2°. The inner housing can be formed with a small wall thickness, as a result of which material and costs can particularly advantageously be saved.

It is furthermore proposed that the machine housing is provided to at least radially support the at least one transmission element in a manner uncoupled from the inner housing. The designation "radially support" is intended to be understood here in particular as an arrangement of the machine housing in relation to the at least one transmission element, wherein the at least one transmission element bears directly or indirectly at least partially against the machine housing so that a flux of force between the at least one transmission element and the machine housing can take place, in particular a flux of force which runs in a substantially perpendicular manner to the rotational axis of a transmission element arranged inside the inner housing and/or to the rotational axis of the tool mount of the portable power tool. As a result, radial bearing forces which proceed from the at least one transmission element can particularly advantageously be supported at the machine housing so that the running accuracy of the at least one transmission element can be positively influenced in a structurally simple manner.

Advantageously, the portable power tool has at least one supporting element which penetrates at least partially through the inner housing in a radial direction. In this context, a "supporting element" is intended to be understood in particular as a component which is provided to transmit forces and/or torques that occur in one component to another component. A "radial direction" is intended to be understood here in particular as a direction which runs in a substantially perpendicular manner to the rotational axis of a transmission element arranged inside the inner housing and/or to the rotational axis of the tool mount of the portable power tool. In this context, "substantially perpendicular" is intended to be understood as a direction which encloses an angle, which has in particular a dimension of between 85° and 95°, with a reference direction. Particularly preferably, the at least one supporting element bears against the machine housing so that radial support, in particular radial support in a manner uncoupled from the inner housing, of the at least one transmission element on the machine housing can be achieved. By means of the configuration according to the disclosure, it is possible advantageously to uncouple the inner housing from a radial support of the at least one transmission element.

Preferably, the supporting element is configured in one piece with a supporting element which is provided to axially support the inner housing. In particular, the supporting element is formed in one piece with an intermediate flange which is provided to axially support the inner housing. The term "in one piece" is intended to be understood here in particular as formed in one part and/or from a casting and/or as a component which is only separable with the aid of a separating and/or cutting tool. In a preferred configuration, the supporting element has a free end that is directed radially outward. It is conceivable to arrange a damping means in the radial direction between the free end of the supporting element and the machine housing, so that vibrations which proceed from the at least one transmission element can be damped in a particularly advantageous manner. See, e.g., the damping member 25 illustrated in FIG. 3. The damping means can be formed from various materials that appear to be practical to a person skilled in the art. Particularly preferably, the damping means is formed from an elastomer. As a result, an operator can advantageously be relieved of load when operating the portable power tool. Furthermore, by means of the configuration according to the disclosure of the portable power tool, installation space, costs and assembly outlay can advantageously be reduced.

In addition, it is proposed that the inner housing has at least one radial cutout which is provided to at least partially receive the supporting element. A "radial cutout" is intended to be understood here in particular as a continuous cutout in a lateral surface, it being possible to guide a component through said cutout perpendicularly to the rotational axis of a transmission element arranged inside the inner housing and/or to the rotational axis of the tool mount of the portable power tool. By means of interaction between the radial cutout in the inner housing and the supporting element, it is possible to realize advantageous support in a structurally simple manner.

In a particularly preferred configuration, the portable power tool comprises an intermediate flange which has at least one supporting element which is provided to axially support at least the inner housing. As a result, axial support of the inner housing can be achieved in a structurally simple manner. Components for realizing the axial support of the inner housing can advantageously be saved.

Preferably, the portable power tool according to the disclosure comprises at least two bearing planes in which the at least one transmission element is supported radially on the machine housing in a manner uncoupled from the inner housing. The bearing planes extend in this case in a substantially perpendicular manner to the rotational axis of a transmission element arranged inside the inner housing and/or to the rotational axis of the tool mount of the portable power tool. Preferably, the at least two bearing planes are arranged in a manner spaced apart from one another in an axial direction which extends in a substantially parallel manner to the rotational axis of a transmission element arranged inside the inner housing and/or to the rotational axis of the tool mount of the portable power tool, specifically preferably with an axial spacing of at least 2 cm. Particularly preferably, in each case at least one radial bearing is arranged in the at least two bearing planes. As a result, a particularly advantageous flux of force can be achieved.

Furthermore, it is proposed that the inner housing is formed in a shell-like manner. The expression "shell-like" is intended to be understood here in particular as a structure in which the inner housing is formed from at least two housing half-shells which can be connected together along a connecting plane by means of connecting elements known to a person skilled in the art. Particularly preferably, the connecting plane of the housing half-shells of the inner housing extends through the rotational axis of a transmission element arranged inside the inner housing and/or through the rotational axis of the tool mount of the portable power tool. As a result, components, in particular transmission elements, arranged in the inner housing can advantageously be accessed for the purposes of maintenance and/or fitting and/or repair.

BRIEF DESCRIPTION OF DRAWINGS

Further advantages can be gathered from the following description of the drawing. The drawing illustrates an exemplary embodiment of the disclosure. The drawing, the description and the claims contain numerous features in combination. A person skilled in the art will expediently also consider the features individually and combine them to form practical further combinations.

In the drawing.

DETAILED DESCRIPTION

Figure 1:
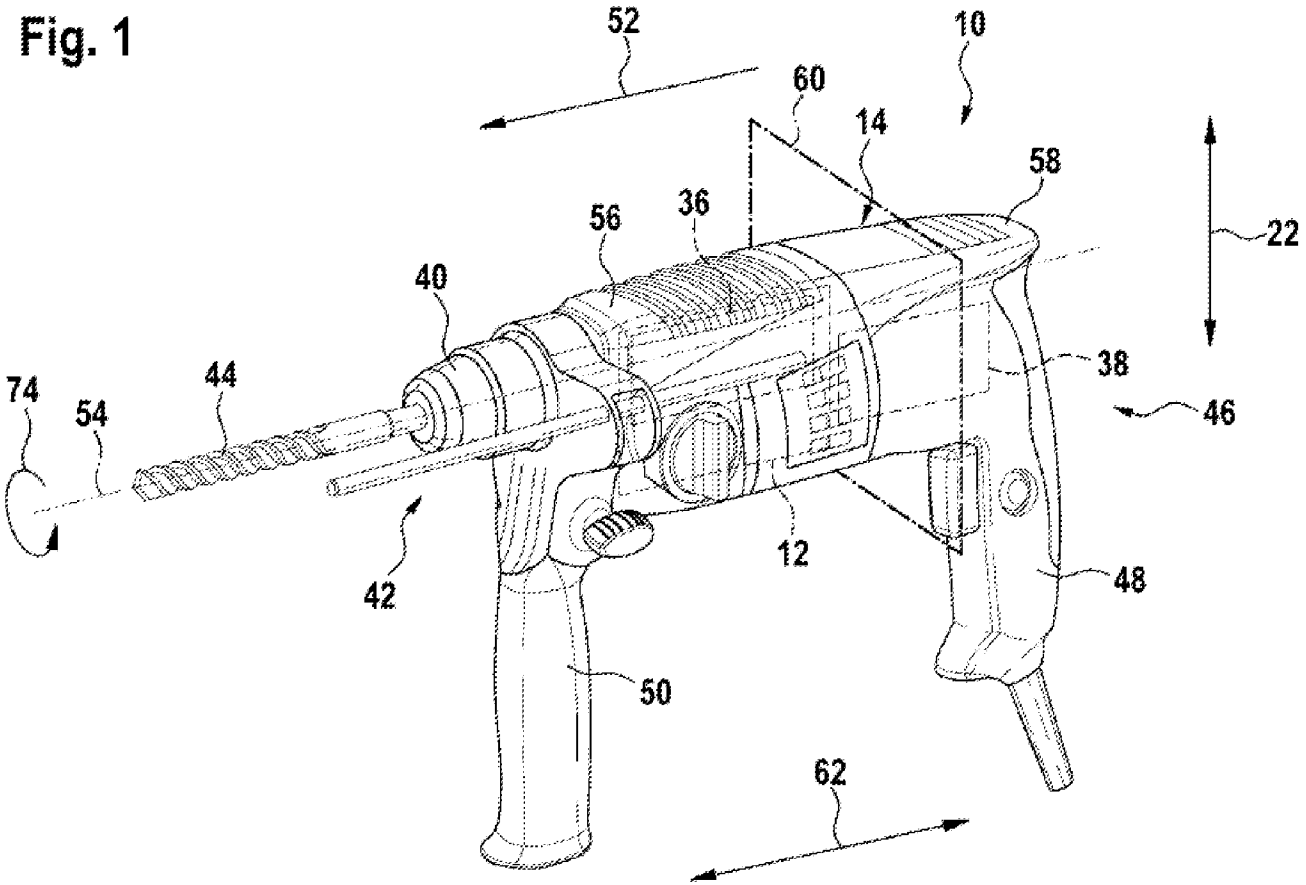
FIG. 1 shows a portable power tool according to the disclosure.

FIG. 1 shows a portable power tool 10 according to the disclosure, which is in the form of a rotary and/or demolition hammer. The portable power tool 10 comprises a transmission 12, a machine housing 14 and an inner housing 16 (FIG. 2) arranged inside the machine housing 14, said inner housing being provided to receive a transmission element 18 of the transmission 12. In this case, the transmission element 18 is mounted in a manner distributed between the inner housing 16 and the machine housing 14. The transmission 12 comprises a percussion mechanism 36 for producing a percussive pulse. The transmission 12 is connected to a drive unit 36 (not shown in more detail here) that produces a drive torque. The percussive pulse of the percussion mechanism 36 and a rotation of an intermediate shaft of the percussion mechanism 36, of a hammer tube of the percussion mechanism 36 and of a tool mount 40 of the portable power tool 10 are produced in a manner known to a person skilled in the art and so this is not described in more detail here.

The tool mount 40 of the portable power tool 10 is arranged in a front region 42 of the portable power tool 10 and is provided to receive a tool 44. On a side 46 remote from the front region 42, the portable power tool 10 comprises a main handle 48 for actuating the portable power tool 10 and to introduce a force initiated by an operator to the portable power tool 10. The portable power tool 10 is also executed with a detachable auxiliary handle 50. In this case, the auxiliary handle 50 can be fastened in a detachable manner to the portable power tool 10 via a latching connection or other connections that appear to be practical to a person skilled in the art. The auxiliary handle 50 is arranged on the portable power tool 10 in the vicinity of the tool mount 40 so that the portable power tool 10 can be guided by the operator. A main extension direction 52 of the portable power tool 10 extends from the main handle 48 in the direction of the tool mount 40. In this case, the main extension direction 52 extends parallel to a rotational axis 54 of the tool 44 located in the tool mount 40 and to a rotational axis 54 of the transmission element 18 in the form of a hammer tube. Inside the transmission element 18 in the form of a hammer tube there are arranged a percussive pin, a striker and a hammer pin (not illustrated in more detail here) for transmitting the percussive pulse to the tool 44.

Figure 2:
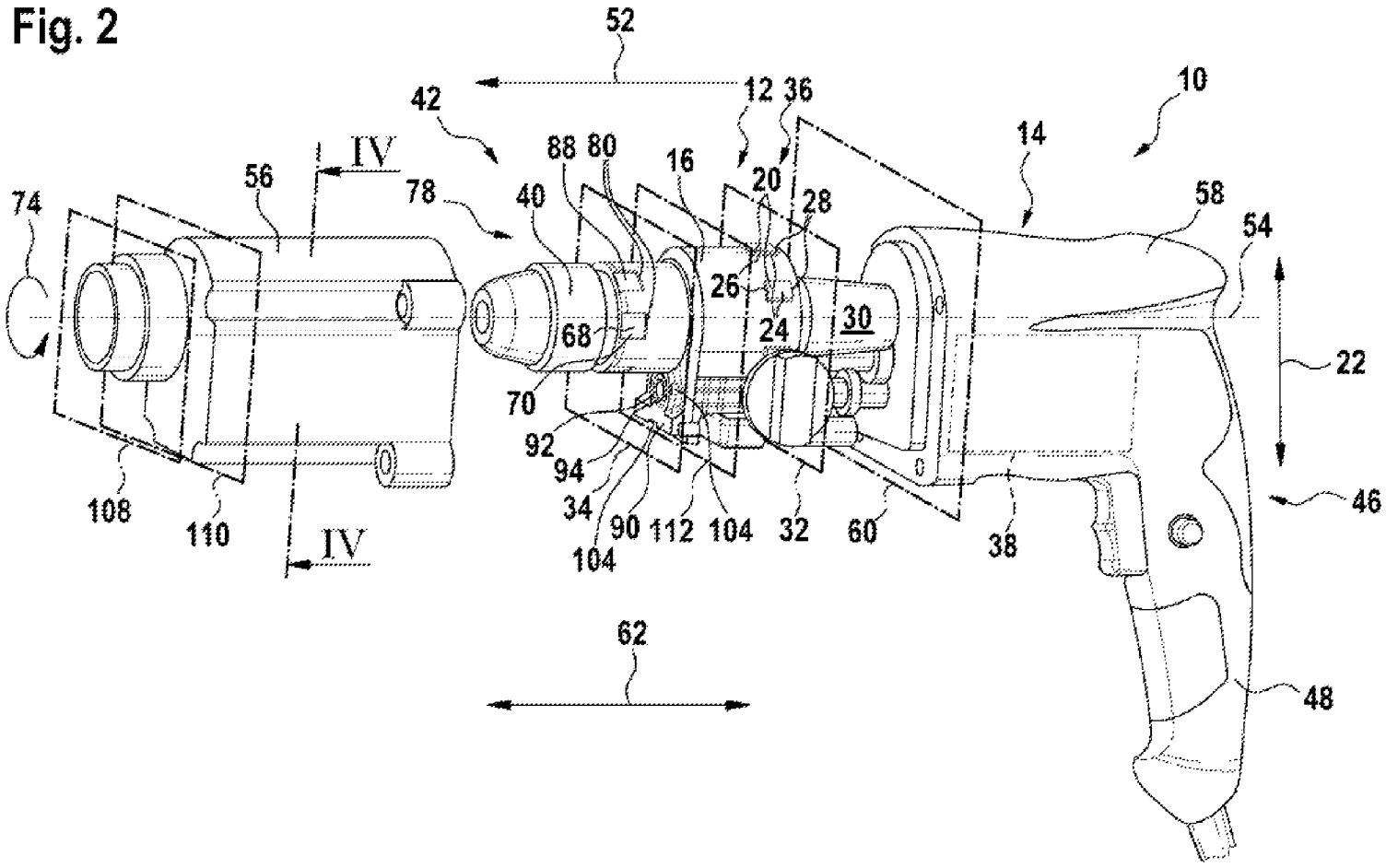
FIG. 2 shows the portable power tool according to the disclosure with the machine housing opened.

FIG. 2 shows the portable power tool 10 according to the disclosure with the machine housing 14 opened. The machine housing 14 comprises a pot-like transmission housing 56 and a pot-like motor housing 58. In the assembled state, the transmission housing 56 and the motor housing 58 are connected together in a connecting plane 60 such as to be separable in a manner known to a person skilled in the art. The connecting plane 60 extends perpendicularly to the rotational axis 54 of the tool 44 located in the tool mount 40 and to the rotational axis 54 of the transmission element 18 in the form of a hammer tube. The motor housing 58 is formed partially in one piece with the main handle 48. Furthermore, the drive unit 38, which is in the form of an electric motor, (not illustrated in more detail here) is arranged inside the motor housing 58. The inner housing 16, which is arranged inside the transmission housing 56 in the assembled state of the transmission housing 56, is provided to axially support the transmission element 18 in the form of a hammer tube.

The transmission element 18 in the form of a hammer tube is mounted inside the inner housing 16 (FIG. 5) by means of a bearing element 66 in the form of a bearing bush 64 and of a bearing element 70 in the form of a ball bearing 68. The bearing bush 64 is arranged in this case in an intermediate flange 30 of the portable power tool 10, said intermediate flange 30 being arranged partially inside the mounted inner housing 16. Furthermore, the intermediate flange 30 has a supporting element 20, 24, which is provided to axially support the inner housing 16. The supporting element 20, 24 is formed in this case in one piece with the intermediate flange 30. The inner housing 16 has a radial cutout 28, which is provided to partially receive the supporting element 20, 24. Furthermore, the inner housing 16 has grooves 72 for receiving the ball bearing 68 and the intermediate flange 30, said grooves 72 extending in a circumferential direction 74 in the inner housing 16. The circumferential direction 74 extends in a plane which extends perpendicularly to the rotational axis 54 of the tool 44 located in the tool mount 40 and to the rotational axis 54 of the transmission element 18 in the form of a hammer tube. As a result of interaction of peripheral regions 76 of the grooves 72, the radial cutouts 28 in the inner housing 16 and the supporting element 20, 24, the inner housing 16 is supported on the intermediate flange 30 in the axial direction 62. The transmission element 18 in the form of a hammer tube is supported axially on the inner housing 16 via the ball bearing 68 arranged in one of the grooves 72 in the inner housing 16 and one of the peripheral regions 76 of the grooves 72.

Furthermore, the portable power tool 10 has a supporting element 20, 24, which penetrates partially through the inner housing 16 in a radial direction 22. This supporting element 20, 24 is configured in one piece with the supporting element 20, 24 which is provided to axially support the inner housing 16. In the assembled state of the machine housing 14 and the inner housing 16, the supporting element 20, 24 extends, starting from the intermediate flange 30, in the direction of the transmission housing 56 through the cutout 28 in the inner housing 16. The supporting element 20, 24 has a free end 26 which is directed radially outward and bears against the transmission housing 56 in the assembled state of the portable power tool 10. The transmission element 18 in the form of a hammer tube is supported radially on the machine housing 14, in particular on the transmission housing 56, in a manner uncoupled from the inner housing 16. The intermediate flange 30 has a total of six supporting elements 20, 24, which are formed partially in one piece with the intermediate flange 30. The inner housing 16 has in this case six cutouts 28 for receiving the six supporting elements 20, 24. The six supporting elements 20, 24 are in this case arranged at an equal spacing in the circumferential direction 74 on the intermediate flange 30. Furthermore, the six cutouts 28 are likewise arranged at an equal spacing in the circumferential direction 74 on the inner housing 16. However, it is also conceivable for more than six supporting elements 20, 24 or fewer than six supporting elements 20, 24 to be provided, depending on the requirements, and so a person skilled in the art will provide a number of supporting elements 20, 24 and cutouts 28 that is practical for a particular requirement.

Figure 3:
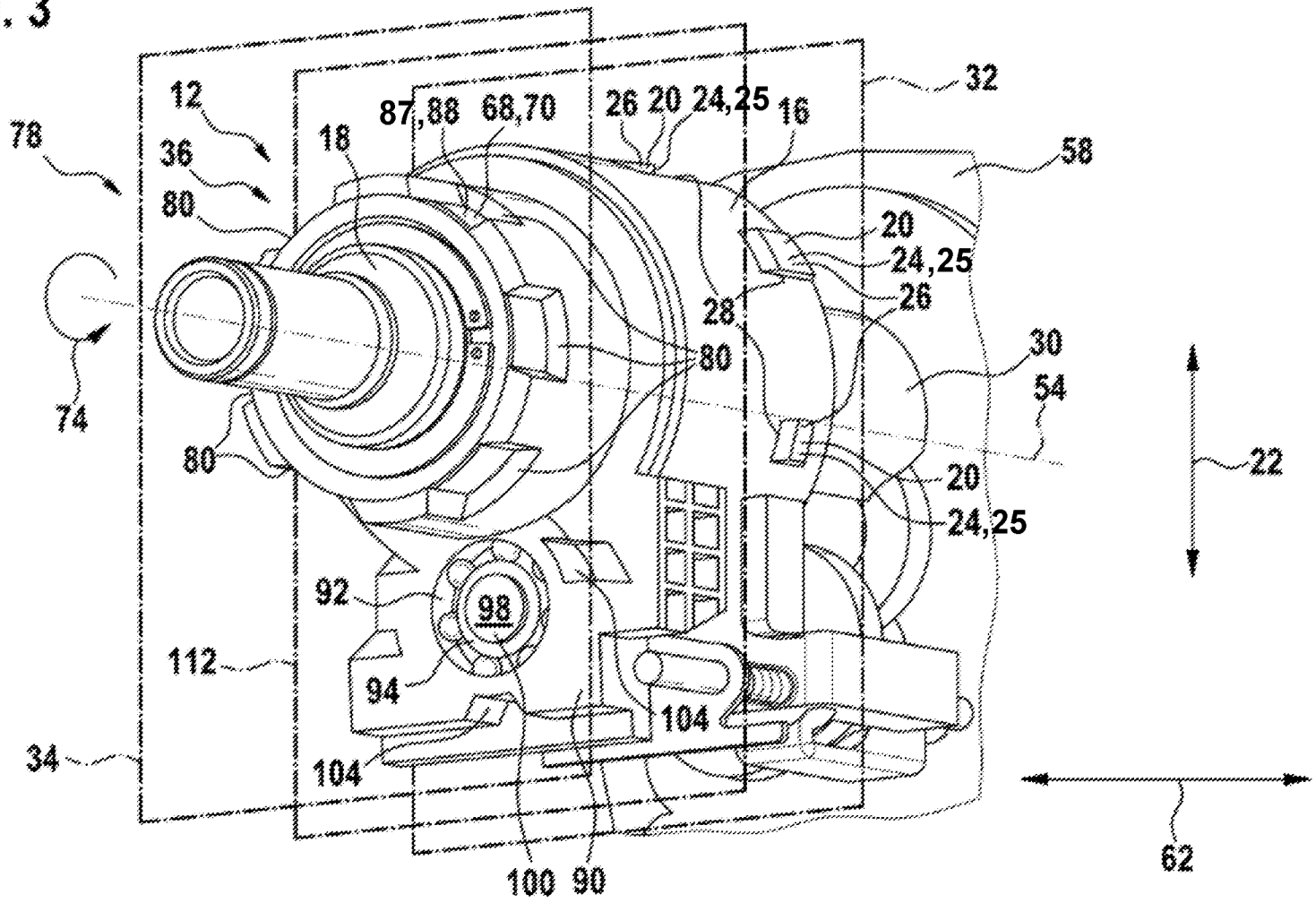
FIG. 3 shows a detail view of a mounted inner housing of the portable power tool according to the disclosure.
Figure 4:
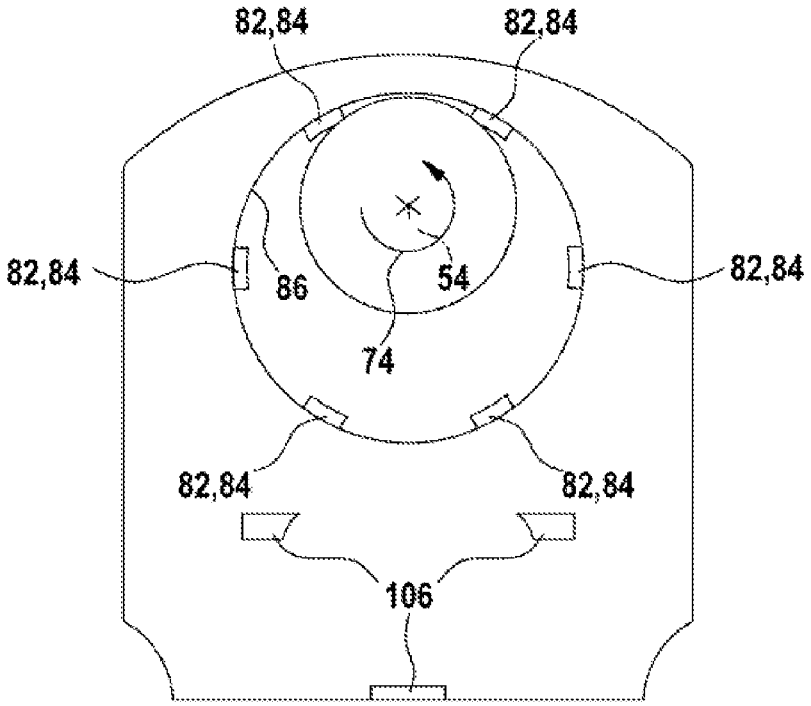
FIG. 4 shows a schematic sectional illustration of the machine housing along the line IV-IV in FIG. 2 of the portable power tool according to the disclosure.

FIG. 3 shows a detail view of the mounted inner housing 16 of the portable power tool 10 according to the disclosure, wherein the transmission housing 56 has been removed. On a side 78 of the inner housing 16 that faces the tool mount 40, the ball bearing 68 for mounting the transmission element 18 in the form of a hammer tube is arranged in one of the grooves 72 in the assembled state of the inner housing 16. On this side 78, the inner housing 16 has a cutout 80, which is provided to receive a radial element 82 of the transmission housing 56. The inner housing has a total of six cutouts 80 for receiving a radial element 82. The radial element 82 is in the form of a radial extension 84 of the transmission housing 56 (FIG. 4). The radial extension 84 is arranged on an inner side 86 of the transmission housing 56, said inner side 86 being directed toward the inner housing 16 in the assembled state of the transmission housing 56. The transmission housing 56 has a total of six radial extensions 84, which engage in each case in one of the six cutouts 80 in the inner housing 16 in the assembled state of the transmission housing 56. However, it is also conceivable for more than six radial extensions 84 or fewer than six radial extensions 84 to be provided, depending on the requirements, and so a person skilled in the art will provide a number of radial extensions 84 and cutouts 80 that is practical for a particular requirement. The ball bearing 68 arranged in the inner housing 16 comprises an outer race 88 which bears against the radial extensions 84 in the assembled state of the transmission housing 56. It is conceivable for damping means 87 to be arranged between the radial extensions 84 of the transmission housing 56 and the outer race 88 of the ball bearing 68, said damping means 87 being provided to damp vibrations. By means of interaction between the outer race 88 of the ball bearing 68 and the radial extensions 84 of the transmission housing 56, the transmission element 18 in the form of a hammer tube is supported radially on the transmission housing 56. As a result, radial forces, which proceed from the transmission element 18 in the form of a hammer tube, are transmitted into the transmission housing 56. The radial extensions 84 of the transmission housing 56 are inserted in the axial direction 62 into the cutouts 80 in the already mounted inner housing 16 when the transmission housing 56 is mounted.

Furthermore, the inner housing 16 has a bearing extension 90 which extends in a radial direction 22. In the assembled state of the transmission housing 56, the bearing extension 90 extends from the inner housing 16 in the direction of the transmission housing 56. The bearing extension 90 is provided to receive a bearing element 94 in the form of a ball bearing 92. To this end, the bearing extension 90 has a groove 96, which extends in the circumferential direction 74 in the bearing extension 90 of the inner housing 16. The ball bearing 92 is provided to mount a shaft 100, in the form of an intermediate shaft 98, of the transmission 12. The intermediate shaft 98 is supported axially in this case by means of interaction between the ball bearing 92 and peripheral regions 102 of the groove 96 in the inner housing 16. In order to radially support the intermediate shaft 98, the bearing extension 90 has a cutout 104, which is provided to receive a supporting element 106 of the transmission housing 56. The bearing extension 90 has a total of three cutouts 104 (FIG. 4) and the transmission housing 56 comprises three supporting elements 106, wherein in each case one cutout 104 receives one supporting element 106. The supporting elements 106 of the transmission housing 56 are provided to radially support the intermediate shaft 98 via the ball bearing 92. The supporting elements 106 of the transmission housing 56 are inserted in the axial direction 62 into the cutouts 104 in the bearing extension 90 of the already mounted inner housing 16 when the transmission housing 56 is mounted.

The portable power tool 10 comprises two bearing planes 32, 34, a first bearing plane 32 and a second bearing plane 34, in which the transmission element 18 in the form of a hammer tube is supported radially on the machine housing 14 in a manner uncoupled from the inner housing 16. The two bearing planes 32, 34 extend in this case perpendicularly to the rotational axis 54 of the tool 44 located in the tool mount 40 and to the rotational axis 54 of the transmission element 18 in the form of a hammer tube. The supporting elements 20, 24, a subregion of the intermediate flange 30, the bearing bush 64 and a subregion of the transmission element 18 in the form of a hammer tube are arranged in the first bearing plane 32 in the assembled state of the machine housing 14 and the inner housing 16. The radial extensions 84 of the transmission housing 56, the ball bearing 68 and a subregion of the transmission element 18 in the form of a hammer tube are arranged in the second bearing plane 34 in the assembled state of the machine housing 14 and the inner housing 16.

FIG. 4 shows a schematic sectional illustration of the machine housing 14, in particular the transmission housing 56, of the portable power tool 10 according to the disclosure. The radial extensions 84 of the transmission housing 56 are arranged in a plane 108 (FIG. 2), which extends perpendicularly to the rotational axis 54 of the tool 44 located in the tool mount 40 and to the rotational axis 54 of the transmission element 18 in the form of a hammer tube in the assembled state of the transmission housing 56. Furthermore, the radial extensions 84 are arranged at an equal spacing in the circumferential direction 74 in the plane 108. The plane 108 forms the second bearing plane 34 of the portable power tool 10 in the assembled state of the transmission housing 56.

The supporting elements 106 of the transmission housing 56 are arranged in a plane 110 which extends parallel to the plane 108 (FIG. 2), in which the radial extensions 84 of the transmission housing 56 are arranged. In this case, the plane 110, in which the supporting elements 106 are arranged, is arranged in the axial direction 62 in the direction of the main handle 48 in a manner spaced apart from the plane 108, which has the radial extensions 84 of the transmission housing 56. The plane 110 forms a third bearing plane 112 of the portable power tool 10 in the assembled state of the transmission housing 56. The third bearing plane 112 comprises a subregion of the bearing extension 90 of the inner housing 16, the supporting elements 106, the ball bearing 92 of the intermediate shaft 98 and a subregion of the intermediate shaft 98 in the assembled state of the portable power tool 10.

Figure 5:
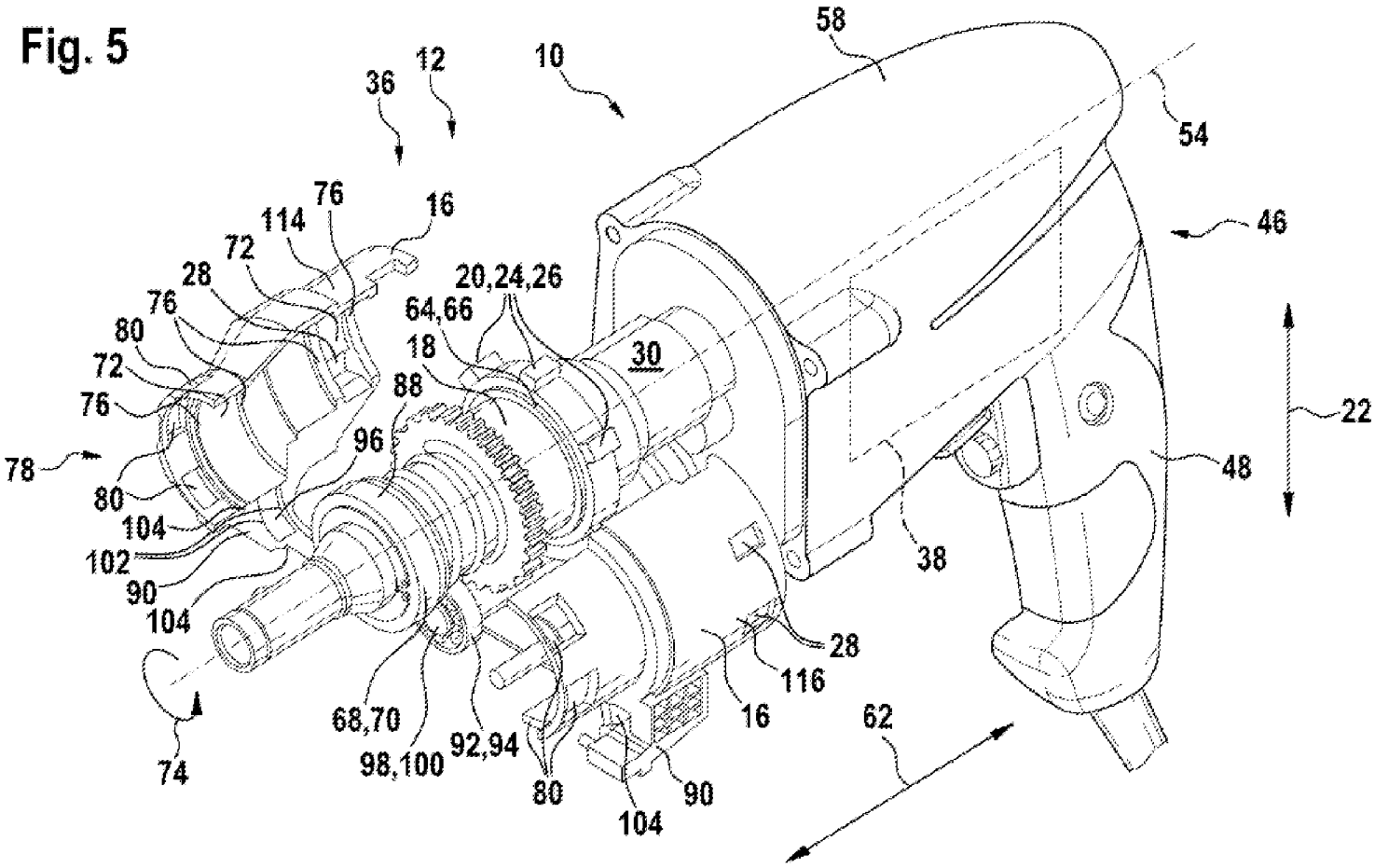
FIG. 5 shows the portable power tool according to the disclosure with the inner housing opened.

FIG. 5 shows the portable power tool 10 according to the disclosure with the inner housing 16 opened and the transmission housing 56 removed. The inner housing 16 is formed in a shell-like manner. In this case, the inner housing 16 comprises two inner housing half-shells 114, 116, which are connected together in a separable manner in a connecting plane. The connecting plane extends through the rotational axis 54 of the tool 44 located in the tool mount 40 and through the rotational axis 54 of the transmission element 18 in the form of a hammer tube.

The invention claimed is:

1. A portable power tool, comprising:

a transmission having at least one transmission element, a machine housing, an inner housing arranged inside the machine housing, said inner housing being configured to at least partially receive the at least one transmission element of the transmission, and at least one supporting element configured to axially support the inner housing, and to penetrate at least partially through the inner housing in a radial direction and radially bear against an inner surface of the machine housing, wherein the at least one transmission element is mounted in a manner distributed between the inner housing and the machine housing, and wherein the at least one transmission element is supported radially on the machine housing in at least two bearing planes in a manner uncoupled from the inner housing.

2. The portable power tool as claimed in claim 1, wherein the inner housing is configured to at least axially support the at least one transmission element.

3. The portable power tool as claimed in claim 1, wherein the machine housing is configured to at least radially support the at least one transmission element in a manner uncoupled from the inner housing.

4. The portable power tool as claimed in claim 1, wherein the supporting element is configured in one piece with another supporting element which is configured to axially support the inner housing.

5. The portable power tool as claimed in claim 1, wherein the supporting element has a free end that is directed radially outward.

6. The portable power tool as claimed in claim 1, wherein the inner housing has at least one radial cutout which is configured to at least partially receive the supporting element.

7. The portable power tool as claimed in claim 1, further comprising an intermediate flange which has at least one supporting element which is configured to axially support at least the inner housing.

8. The portable power tool as claimed in claim 1, wherein the inner housing is formed from at least two housing half-shells connected together along a connecting plane that extends through a rotational axis of the transmission element.

9. A portable power tool, comprising:

a machine housing;

a supporting element that is positioned within the machine housing and that is radially supported by the machine housing in an uncoupled fashion;

an inner housing that is axially supported by the supporting element; and a transmission that includes at least one transmission element;

the at least one transmission element being axially supported by the inner housing such that the at least one transmission element is axially uncoupled from the machine housing; and the at least one transmission element being radially supported by the machine housing such that the at least one transmission element is radially uncoupled from the inner housing.

10. The portable power tool according to claim 9, the supporting element including at least one free end that extends radially outward toward the machine housing, such that the machine housing is configured to radially bear against the at least one free end to radially support the supporting element.

11. The portable power tool according to claim 10, wherein:

the inner housing is positioned radially outwards and around the supporting element; and the inner housing defines at least one radial cutout configured such that the free end of the supporting element penetrates through the inner housing and toward the machine housing.

12. The portable power tool according to claim 10, wherein the portion of the supporting element extending through the at least one radial cutout of the supporting element is configured to axially bear against the inner housing to axially support the inner housing.

13. The portable power tool according to claim 12, further comprising at least one damping element positioned between the at least one free end of the supporting element and the machine housing, the damping element being configured to damp vibrations of the at least one transmission element from the machine housing.

14. The portable power tool according to claim 9, wherein:

the at least one transmission element defines a bearing element; and the inner housing defines at least one groove that interacts with the bearing element to axially support the at least one transmission element and to form a ball bearing between the inner housing and the at least one transmission element.

15. The portable power tool according to claim 14, wherein:

the machine housing defines at least one radial extension that extends radially inward toward the at least one transmission element; and the at least one groove includes at least one cutout configured such that the at least one radial extension of the machine housing extends through the at least one cutout and bears against an outer surface of the ball bearing to radially support the at least one transmission element.

16. The portable power tool according to claim 14, further comprising at least one damping element positioned between the at least one radial extension of the machine housing and the outer surface of the ball bearing, the damping element being configured to damp vibrations of the at least one transmission element from the machine housing.

17. The portable power tool according to claim 9, wherein:

the at least one transmission element defines a rotational axis;

the machine housing is formed from two half-shell pieces that are joined in a plane substantially normal to the rotational axis; and the inner housing is formed from two half-shell pieces that are joined in a further plane oriented such that the rotation axis lies on the further plane.

18. The portable power tool according to claim 9, wherein the supporting element is integral with an intermediate flange positioned on the transmission so as to be partially inside of the inner housing.

* * * * *